United States Patent [19]

Borowski et al.

[11] Patent Number: 4,621,651

[45] Date of Patent: Nov. 11, 1986

[54] FILTER TIP FOR A SMOKING PRODUCT

[75] Inventors: Horst Borowski; Knut Möller; Wolfgang Wiethaup, all of Hamburg; Günther Rodemeyer, Seevetal; Paul-Georg Henning, Quickborn; Erhard Köhn, Hamburg, all of Fed. Rep. of Germany

[73] Assignee: B.A.T. Cigaretten-Fabriken GmbH, Hamburg, Fed. Rep. of Germany

[21] Appl. No.: 547,832

[22] Filed: Nov. 2, 1983

[30] Foreign Application Priority Data

Nov. 13, 1982 [DE] Fed. Rep. of Germany ..... 3242081
Jul. 15, 1983 [DE] Fed. Rep. of Germany ..... 3325689

[51] Int. Cl.[4] ..... A24D 3/04; A24D 3/18

[52] U.S. Cl. ..... 131/361; 131/340; 131/338

[58] Field of Search ..... 131/369, 339, 340, 338

[56] References Cited

U.S. PATENT DOCUMENTS

| | | | |
|---|---|---|---|
| 170,752 | 12/1875 | Marquis | 131/361 |
| 235,885 | 12/1880 | Lindsley | 131/361 |
| 269,256 | 12/1882 | Bourgeois | 131/361 |
| 2,669,238 | 2/1954 | Rawlings | 131/361 |

FOREIGN PATENT DOCUMENTS

| | | |
|---|---|---|
| 0025327 | 3/1981 | European Pat. Off. . |
| 0039591 | 11/1981 | European Pat. Off. . |
| 1336465 | 11/1973 | United Kingdom . |

*Primary Examiner*—V. Millin
*Attorney, Agent, or Firm*—Arnold, White & Durkee

[57] ABSTRACT

A filter tip for a smoking product comprised of a filter rod attached at one end to the smoking product. The filter rod is surrounded by a tip wrapping layer which terminates at a distance from the mouth end of the filter rod. The projecting end of the rod is tapered toward the mouth end. The taper causes smoke drawn through the filter tip to flow out obliquely with respect to the longitudinal axis of the smoking product.

19 Claims, 7 Drawing Figures

FILTER TIP FOR A SMOKING PRODUCT

BACKGROUND OF THE INVENTION

The invention relates to a filter tip for a smoking product, in particular a cigarette, having a filter rod of substantially circular, oval or lenticular cross-section surrounded by a tip wrapping layer, in which the smoke flowing in the direction of the logitudinal axis of the filter is deflected out of the direction of flow in the zone of the mouth end of the filter rod.

Filter tips of the above-mentioned type have been disclosed in European Laid Open Application No. 0,025,327, FIG. 5, and in European Laid Open Application No. 0,039,591. In these prior art filters, the smoke arriving at the mouth end of the filter rod is deflected by obstacles to flow.

The concentration of smoke in certain filter areas leads to a beneficial effect on the flavor of the smoke formed. However, each such known filter has the disadvantage that at least one additional operation is necessary subsequent to the conventional stages of cigarette manufacture in order to apply to the smoke exit surface the obstacle to flow.

The present invention produces a filter tip of the type mentioned initially which can be processed in the course of conventional cigarette manufacture without reducing production speeds. The special filter modification measures take place before the tobacco rod and filter rod are joined thus simplifying manufacture of the cigarette.

SUMMARY OF THE INVENTION

The present invention relates to a filter tip for a smoking product. The filter tip is comprised of a filter rod which is attached to the end of the smoking product. A tip wrapping layer surrounds the filter rod and is terminated at a distance from the mouth end of the filter rod. The projecting end of the filter rod tapers in the direction of the flow of smoke through the filter.

DESCRIPTION OF THE INVENTION

Figure 1:
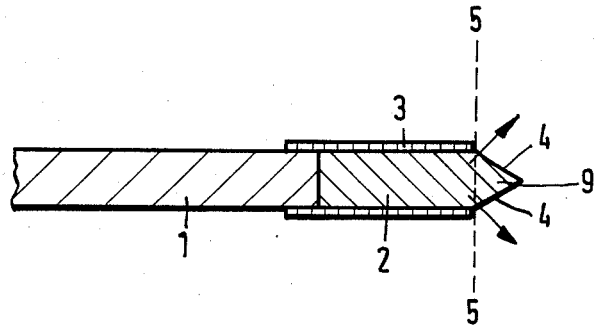
FIG. 1, in longitudinal section, shows an embodiment of a filter tip according to the invention with a conical end of the filter rod.
Figure 2:
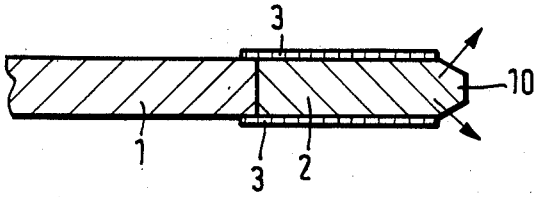
FIG. 2, in longitudinal section, shows another embodiment of a filter tip according to the invention with the end of the filter rod designed in the form of a truncated cone.
Figure 3:
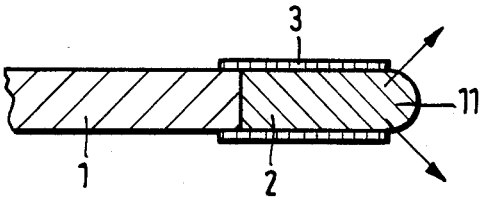
FIG. 3, in longitudinal section, shows another embodiment of a filter tip according to the invention with the end of the filter rod designed in the form of a sphere.
Figure 4:
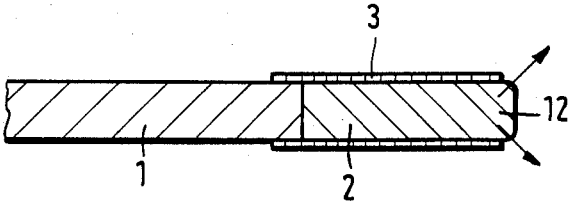
FIG. 4, in longitudinal section, shows another embodiment of a filter tip according to the invention with the end of the filter rod designed in the form of a segment of a sphere.
Figure 5:
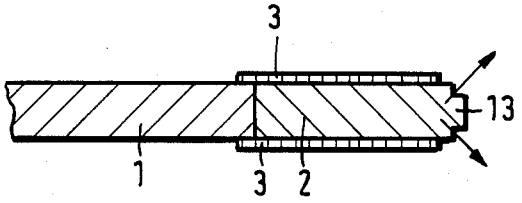
FIG. 5, in longitudinal section, shows another embodiment of a filter tip according to the invention with a design of the end of the filter rod which tapers stepwise.

The filter tip is constructed from a filter rod comprised of conventional filter materials known to the art. The filter rod can have a substantially circular, oval or lenticular cross-section. The filter rod is surrounded by a tip wrapping layer which at its mouth end terminates at a distance in front of the end of the filter rod. The projecting end of the filter rod is so constructed as to taper in the direction in which the smoke flows.

If the mouth end of the filter rod of the filter tip is formed by oblique, planar surfaces, then, during smoking, the stream of smoke from the longer part of the filter rod is deflected and emerges approximately at right angles to the oblique surfaces. This results in the desired beneficial effect on flavor. This effect is particularly beneficial in the case of so-called mild cigarettes. Similar principles apply in the case where the limiting surfaces are curved. Given suitable shaping, the stream of smoke will normally seek the shortest path out of the filter; in other words the smoke will flow out obliquely with respect to the longitudinal axis of the cigarette, rather than following the longer path in the direction of the longitudinal axis of the filter.

Filter tips according to the invention can in general be processed in conventional cigarette-making machines. In modern cigarette-making machines, the manner in which the cigarettes are manufactured is that tobacco rods wrapped in paper are applied to both ends of a double filter; the double filter is then cut through vertically and centrally by a rapidly rotating knife.

The production of filter tips with a plurality of limiting surfaces requires measures deviating somewhat from the above; in particular, it is very simple if the projecting ends of the filter rods are designed to be blunt at the end, and their shape is symmetrical in respect of rotation, based on the central longitudinal axis of the cigarette. Examples of such shapes include truncated cones, segments of a sphere, or truncated ellipsoids, or filter ends tapered stepwise. To manufacture such shapes an appropriately shaped groove is formed in the center of the double filter. The double filter, after being combined with the tobacco rods, is then cut through vertically at the center of the groove.

The projecting end of the filter rod of the filter tip according to the invention is preferably constructed substantially in the form of a cone or truncated cone, in the form of a sphere, in the form of a cup or segment of a sphere, in the manner of an ellipsoid or segment of an ellipsoid, or with a stepped shape.

However, it is also possible for a plurality of planar and/or non-planar, for example spherically curved, surfaces to be provided which extend in each case obliquely towards one another. For example end surfaces of conical construction with the apex pointing in the direction of flow, namely towards the mouth of the smoker can be utilized.

The invention is applicable not only to filters with tip wrapping paper which is impermeable to air, but also, surprisingly, to those with tip wrapping paper which is permeable to air, in other words to so-called side-ventilated filters.

Further features of the invention are apparent from the description which follows of preferred illustrative embodiments, reference being made to the drawings. The applicability of the filter tip according to the invention is not restricted to cigarettes; it can also be employed, for example, in the case of cigarillos and the like.

The filter tip according to FIG. 1 comprises a filter rod 2 attached to a tobacco rod 1. The filter rod is surrounded by a tip wrapping paper 3 which partially surrounds the filter rod terminating at a distance from the mouth end of the filter rod. If appropriate, a connecting strip (not shown) may also be provided to connect the filter rod and the tobacco rod. At its end adjacent to the tobacco rod 1, the filter rod 2 is cut vertically, in a conventional manner. At the mouth end of the filter rod, the limiting surfaces 4 of the filter rod 2 form an angle $\alpha$ of, for example, 45 degrees with the plane, designated 5, passing through a cross-section of the filter rod perpendicular to the longitudinal axis of the rod. A cone 9 is thus formed. The angle $\alpha$ should not be less than 5 degrees and is preferably between about 20 degrees and about 45 degrees. As the filter rod 2 consists of fibers conventionally used for cigarettes, such as cellulose acetate fibers or foamed, open-pore filter material, no problems arise due to the emergence of filter material from the mouth end of the filter rod.

The embodiments according to FIGS. 2–6 relate to other designs of the filter tips according to the invention in which the mouth end of the filter rod again projects beyond the tip wrapping paper 3. As can be seen from the drawings, the filter rod 2 can be designed at the mouth end in the form of a truncated cone 10, a hemisphere 11, a segment of a hemisphere 12 or tapering steps 13. The preferred directions of smoke emergence are indicated by arrows. In the case of the truncated cone design shown in FIG. 2, the angle $\alpha$ can be as high as 75 degrees.

Figure 6:
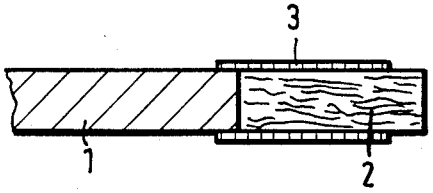
FIG. 6, in longitudinal section, shows another embodiment of a filter tip according to the invention for use in cigarettes of oval or lenticular cross-section.
Figure 7:
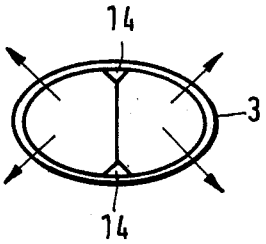
FIG. 7 shows a plan view of the embodiment shown in FIG. 6, viewed from the mouth side of the end of the filter rod.

The embodiment according to FIG. 6 is particularly suitable for cigarettes of oval or lenticular crosssection, since in this case, in accordance with the preferred direction of smoke flow corresponding to the arrows according to FIG. 7, the smoke can be guided, for example, into the smoker's cheek cavities.

The smoke emergence surfaces of the mouth end of the filter rod in the embodiments according to FIGS. 1–7 may also be partly sealed so as to be impermeable to air; the suitable positions for this are, for example, indicated by the reference numeral 14 in FIG. 7.

Cigarettes having tips of the type shown here have a markedly fuller smoke flavor in comparison with those having conventional filter tips. In addition, the sharpness and roughness of the smoke are reduced. The filtering effect of filter tips modified in accordance with the invention is the same as in the case of the conventional filter tips. No changes were detected in the composition of the constituents of the smoke.

Modifications and variations of the invention will be apparent to those skilled in the art. Applicant intends that the following claims cover all such equivalent modifications and variations as fall within the true spirit and scope of the invention.

What is claimed is:

1. A filter tip for a smoking product comprised of:

a porous filter rod attached at one end to said smoking product and having opposite said attached end a mouth end, having at least one smoke exit surface, a tip wrapping layer partially surrounding said filter rod, wherein said tip wrapping layer terminates at a distance in front of the mouth end of said filter rod so as to create a projecting end of said filter rod extending beyond said tip wrapping layer, said projecting end being tapered toward the mouth end of said filter rod, said taper causing smoke drawn through said filter tip to flow out obliquely with respect to the longitudinal axis of said smoking product.

2. The filter tip of claim 1 wherein said projecting end is substantially in the shape of a cone.

3. The filter tip of claim 1 wherein said projecting end is substantially in the shape of a truncated cone.

4. The filter tip of claim 1 wherein said projecting end is substantially in the shape of a sphere.

5. The filter tip of claim 1 wherein said projecting end is substantially in the shape of a segment of a sphere.

6. The filter tip of claim 1 wherein said projecting end is substantially in the form of an ellipsoid.

7. The filter tip of claim 1 wherein said projecting end is substantially in the shape of a segment of an ellipsoid.

8. The filter tip of claim 1 wherein said projecting end is tapered stepwise.

9. A filter tip for a smoking product comprised of:

a porous filter rod attached at one end to said smoking product and having opposite said attached end a mouth end having smoke exit surfaces formed by a plurality of limiting surfaces, a tip wrapping layer partially surrounding said filter rod, wherein said tip wrapping layer terminates at a distance in front of the mouth end of said filter rod so as to create a projecting end of said filter rod extending beyond said tip wrapping layer, said projecting end being tapered toward the mouth end of said filter rod, said taper causing smoke drawn through said filter tip to flow out obliquely with respect to the longitudinal axis of said smoking product.

10. The filter tip of claim 9 wherein said limiting surfaces are planar.

11. The filter tip of claim 9 wherein said limiting surfaces are non-planar.

12. The filter tip of claim 9 wherein said limiting surfaces are both planar and non-planar.

13. the filter tip of claim 9 wherein said limiting surfaces from an angle of not less than 5 degrees from a plane passing through a cross section of said filter rod perpendicular to said filter rod's longitudinal axis.

14. The filter tip of claim 9 wherein said limiting surfaces form an angle of about 20 degrees to about 45 degrees from a plane passing through a cross section of said filter rod perpendicular to said filter rod's longitudinal axis.

15. The filter tip of claims 1, 2, 3, 4, 5, 6, 7, 8 or 9, wherein at least one of said smoke exit surfaces is completely or partially sealed so as to be impermeable to air.

16. A filter tip for a smoking product comprised of:

a porous filter rod attached at one end to said smoking product and having opposite said attached end a mouth end having smoke exit surfaces formed by limiting surfaces, a tip wrapping layer partially surrounding said filter rod, wherein said tip wrapping layer terminates at a distance in front of the mouth end of said filter rod so as to create a projecting end of said filter rod extending beyond said tip wrapping layer, said projecting end being tapered in the form of a cone toward said mouth end, said taper causing smoke drawn through said filter tip to flow out obliquely with respect to the longitudinal axis of said smoking product.

17. The filter tip of claim 16 wherein said limiting surfaces form an angle of not less than 5 degrees from a plane passing through a cross section of said filter rod perpendicular to said filter rod's perpendicular axis.

18. The filter tip of claim 17 wherein said limiting surfaces form an angle of about 20 degrees to about 45 degrees from a plane passing through a cross section of said filter rod's perpendicular axis.

19. The filter tip of claim 17 wherein said cone is truncated.

* * * * *